US008959973B2

(12) United States Patent
Bröβke et al.

(10) Patent No.: US 8,959,973 B2
(45) Date of Patent: Feb. 24, 2015

(54) METHOD AND DEVICE FOR THE CORELESS FORMING OF HOLLOW PROFILES

(75) Inventors: Torsten Bröβke, Duisburg (DE); Michael Brüggenbrock, Rosendahl (DE); Thomas Flehmig, Ratingen (DE); Mohamed Tohfa, Duisburg (DE)

(73) Assignee: ThyssenKrupp Steel AG, Duisburg (DE)

( * ) Notice: Subject to any disclaimer, the term of this patent is extended or adjusted under 35 U.S.C. 154(b) by 1784 days.

(21) Appl. No.: 12/095,566

(22) PCT Filed: Nov. 16, 2006

(86) PCT No.: PCT/EP2006/068571
§ 371 (c)(1),
(2), (4) Date: Aug. 27, 2008

(87) PCT Pub. No.: WO2007/062991
PCT Pub. Date: Jun. 7, 2007

(65) Prior Publication Data

US 2009/0044394 A1 Feb. 19, 2009

(30) Foreign Application Priority Data

Nov. 30, 2005 (DE) ..... 10 2005 057 424

(51) Int. Cl.
*B21C 37/06* (2006.01)
*B21D 51/00* (2006.01)
(Continued)

(52) U.S. Cl.
CPC ..... *B21C 37/0815* (2013.01); *B21D 5/015* (2013.01)
USPC ..... 72/368; 72/51

(58) Field of Classification Search
USPC ..... 72/48–52, 367.1, 368
See application file for complete search history.

(56) References Cited

U.S. PATENT DOCUMENTS 1,872,276 A * 8/1932 Graham ..... 72/368
3,285,490 A * 11/1966 Roper ..... 228/17.5
(Continued)

FOREIGN PATENT DOCUMENTS

DE 966 111 C 7/1957
DE 198 27 798 A1 12/1999
(Continued)

OTHER PUBLICATIONS

Hidaka, English Translation of JP 57047529 A, Mar. 1982, pp. 1-9.*
(Continued)

*Primary Examiner* — Teresa M Ekiert
(74) *Attorney, Agent, or Firm* — Proskauer Rose LLP

(57) ABSTRACT

A method for the production of a hollow section from a blank, wherein the blank is introduced between two coreless halves of a die which have a desired section shape and can be displaced relative to one another and the blank is formed into a slotted hollow section by a closing movement of the halves of the die, includes preventing edges of the blank from sliding ahead during the closing movement of the die. A device for the production of hollow sections, which device has two coreless halves of a die which are positioned displaceably relative to one another and optionally a base plate, the halves of the die having the desired section shape of the hollow section which is to be formed includes means which, when the coreless halves are closing, prevent edges of a blank from sliding ahead to produce a slotted hollow section.

10 Claims, 3 Drawing Sheets

(51) Int. Cl.
*B21C 37/08* (2006.01)
*B21D 5/01* (2006.01)

(56) References Cited

U.S. PATENT DOCUMENTS 4,031,734 A * 6/1977 Imme et al. ..... 72/368
6,494,360 B1 12/2002 Flehmig et al. ..... 228/173.6

FOREIGN PATENT DOCUMENTS

FR 1 254 669 A 11/1967
JP 57047529 A * 3/1982

OTHER PUBLICATIONS

International Search Report for International Application No. PCT/EP2006/068571.

* cited by examiner

METHOD AND DEVICE FOR THE CORELESS FORMING OF HOLLOW PROFILES

CROSS-REFERENCE TO RELATED APPLICATIONS

This application is a National Phase Application of International Application No. PCT/EP2006/068571, filed on Nov. 16, 2006, which claims the benefit of and priority to German patent application no. DE 10 2005 057 424.6-14, filed Nov. 30, 2005. The disclosure of each of the above applications is incorporated herein by reference in their entirety.

FIELD OF THE INVENTION

The invention relates to a method for the production of a hollow section from a blank, wherein the blank is introduced between two halves of a die which have the desired section shape and can be displaced relative to one another and the blank is formed into a slotted hollow section by a closing movement of the halves of the die, and the invention also relates to a device for the production of hollow sections, which device has two halves of a die which are positioned displaceably relative to one another and optionally a base plate, the halves of the die having the desired section shape of the hollow section which is to be formed.

BACKGROUND

In the automotive industry, increasingly complex hollow sections are used to meet the requirements which are imposed in respect of strength and weight in so-called space frame structures. In addition to the forming of straight bead welded pipes into closed hollow sections which are designed to be load-compatible, diverse methods are known from the prior art for the production of hollow sections. A "rolling" method known from German Offenlegungsschrift DE 198 27 798 A1 belonging to the Applicant allows a particularly flexible, yet economic production of load-compatible hollow sections. In this method, a blank is formed in a slotted chamber whereby the blank is introduced by its longitudinal edges respectively into semi-cylindrical form gaps of two halves of a form tool which are in a mutually laterally reversed position and the longitudinal edges emerging from the form gaps in the apex of the form tool are welded together. During welding, the longitudinal edges are held in position by the halves of the form tool. One disadvantage of this method is that a tool which has form gaps, i.e. a tool with an internal mandrel or internal mandrel halves is of a correspondingly complex construction and thus entails relatively high investment costs. Moreover, the surfaces of the die or the mandrel halves are constantly damaged due to their movement relative to the blank. The surface defects then lead to further faults in the subsequent processes, for example to the sheet metal blanks becoming jammed in the form gap.

In addition to this, German patent DE 966 111 discloses a device for bending sheet metal strips round to form pipes of a large diameter, which device consists of two vertically opposite coreless cheek plates having a semi-circular cross-section which, in the starting position, encircle with their lower edges the longitudinal sides of the sheet metal strip over the entire length thereof and, on meeting, roll the sheet metal strip into a pipe. During this forming process, the sheet metal strip is firmly clamped along the central longitudinal axis by a clamping device. However, in the known operation of bending sheet metal strips round into pipes without an internal mandrel, the butt joint, required for welding, of the mutually opposite longitudinal edges of the formed metal sheet is not guaranteed for achieving a constant weld seam, so that a reliable straight bead welding of the hollow sections is not guaranteed. Furthermore, the pipes produced in this manner have to be subjected to an additional calibrating procedure.

SUMMARY OF THE INVENTION

On this basis, the object of the present invention is thus to provide a generic method and a generic device, by which, with a low constructional outlay and with a high procedural reliability, hollow sections can be produced from a blank which, if required, can be flawlessly straight bead welded.

According to a first teaching of the present invention, the aforementioned object for a generic method for producing a hollow section is achieved in that the forming procedure is carried out with coreless halves of the die and the edges of the blank are prevented from sliding ahead during the closing movement of the die to produce a slotted hollow section. All readily formable metals, in particular steel or a steel alloy are considered as blank materials.

It has surprisingly been found that it is possible to dispense with a forming operation of the blank to be formed in form gaps which are produced by a die core and the outer die halves without the quality of the resulting slotted hollow section suffering as a result. Due to the fact that the sliding ahead action of the edges of the blank or of the edges parallel to the longitudinal axis or the bending axis of the hollow section to be formed in the halves of the die is initially prevented, the blank is pressurized in the peripheral direction as the closing movement of the die halves continues. It is only possible for the blank to yield to this pressure directed in the peripheral direction by resting against the outer halves of the die. Thus, while resting against the die halves, the shape of the hollow section to be produced is only taken up by the section shape of the die halves, even without the internal mandrel or die core. Since the blank can form freely inside the halves of the die because the form gap has been dispensed with, the risk of the blank becoming jammed, for example due to surface defects in the die cores, is eliminated and the procedural reliability for the production of the hollow section is greatly improved. At the same time, by means of, for example a tongue or other means to prevent the edges of the blank from sliding ahead, a precise slot is produced in the hollow section between the bent over edges of the blank which allows a procedurally reliable straight bead welding.

According to a first advantageous embodiment of the method according to the invention, to prevent the edges of the blank from sliding ahead, at least one tongue is used which projects into the coreless form cavity. During the closing movement of the die, as already described, the edges of the blank slide along the inner surface of the half of the die until they meet the tongue projecting into the coreless form cavity. If the die closes further, the tongue then ensures the build up of the pressure, directed in the peripheral direction, in the blank, which leads to the expansion of the periphery of the blank and thus to the exact positioning of the blank against the inner form cavity of the two halves of the die. At the same time, the tongue can easily ensure that the slot produced through the opposite edges of the blank has a substantially constant width. The tongue can extend, for example over the entire longitudinal axis of the subsequent hollow section. However, it is also possible to use a tongue which extends only into partial regions of the form cavity.

According to an embodiment of the method according to the invention for the production of a hollow section, a tongue is used which is positioned between the halves of the die or in one half of the die. Whilst the tongue positioned between the halves of the die allows a simple removal of the tongue after the forming process, a tongue positioned in one half of the die opens up the use of stamping or bending presses without considerable modification measures.

The hollow section is preferably fully calibrated during the closing procedure of the halves of the die, i.e. the pressure is increased to such an extent in the peripheral direction that a dimensionally accurate forming of the blank is induced corresponding to the form cavity formed by the halves of the die. Subsequent machining to achieve dimensional accuracy is no longer necessary in this respect for these hollow sections.

According to an embodiment of the method according to the invention, the calibration procedure can also be carried out without a tongue. In this case, advantage is taken of the fact that the opposite edges of the blank can rest against each other at the end of the forming procedure, to thus build up pressure in the peripheral direction.

If the edges of the blank are previously bent in the forming direction, the forming procedure can be initiated in a defined manner, so that the procedural reliability is further increased during the forming procedure.

The method according to the invention for the production of a hollow section is further advantageously configured such that the blank is secured against displacement in the direction of the bending axis. As a result of this measure, it is possible to absorb forces which arise in the direction of the bending axis, for example forming forces which are not distributed uniformly in the longitudinal direction of the hollow section due to a varying diameter along the longitudinal axis of the hollow section which is produced, and to prevent a displacement of the blank during the forming cycle. For this purpose, it is possible to use a stop, for example, which prevents displacement in the direction of the bending axis. A complex "clamping" operation of the blank at one point is unnecessary.

If, after removing the tongue, the hollow section is straight bead welded, in particular in the same device, a closed hollow section can be provided in an economic way involving a few working steps.

"Tailored tubes" are preferably produced by the forming method. "Tailored tubes" are closed hollow sections which are specifically adapted to the load situation and have differing material thicknesses or material qualities. The particular field of application of "tailored tubes" is that of motor vehicle manufacture, to take into account the different loads in various regions of a space frame structure, while at the same time ensuring a minimum weight.

The method according to the invention can be carried out in a particularly economic manner by using a deep drawing press, a press brake or a rolling device. Deep drawing presses and press brakes can be readily adapted by fitting die halves which allow the process to enable the method according to the invention to be carried out. A rolling device which, as already mentioned at the outset, is known from German Offenlegungsschrift DE 198 27 798 A1, can be easily used by employing a coreless die and it preferably simultaneously allows a subsequent straight bead welding of the section. Thus, relatively low investment costs are required to carry out the method according to the invention.

According to a second teaching of the present invention, the aforementioned object is achieved by a generic device in that the halves of the die do not have a core and means are provided which, when the halves of the die are closing, prevent the edges of the blank from sliding ahead to produce a slotted hollow section.

As already mentioned above, the advantages of the device according to the invention are seen in the fact that the method according to the invention can be carried out which has a higher procedural reliability than the method used hitherto. Moreover, due to the use of coreless halves of the die, a corresponding device requires correspondingly lower investment costs than the devices used hitherto with complex internal mandrels or mandrel halves.

According to a next advantageous embodiment of the device according to the invention, the formation of a slot having a constant width between the edges of the blank extending vertically to the direction of movement of the die halves is easily ensured in that a tongue projecting into the interior of the halves of the die is provided. The thickness of the tongue in the region of the contact points of the edges of the blank extending vertically to the direction of movement of the die halves determines the thickness of the slot between these edges and, where the surface of the tongue extends vertically to the end faces of the edges, ensures the formation of an ideal butt joint for welding the two edges together. The tongue preferably extends at least partly parallel to the bending axis of the hollow section to be formed.

According to the invention, the tongue is positioned between the halves of the die or in one half of the die. When the tongue is positioned in one half of the die, this embodiment of the device according to the invention allows the use of deep drawing presses or press brakes for the production of the hollow sections. On the other hand, a tongue which is positioned between the halves of the die affords the possibility of an easy removal of the tongue after forming and a straight bead welding of the hollow section without a further intermediate step.

According to a next developed embodiment of the device according to the invention, means are preferably provided to perform a straight bead welding process, which allow an integrated straight bead welding after the conclusion of the forming procedure.

BRIEF DESCRIPTION OF THE DRAWING

There are a large number of possibilities for developing and configuring the method and the device according to the invention for the production of a hollow section. In this respect, reference is made on the one hand to the Claims and to the description of two exemplary embodiments in conjunction with the drawings, in which FIGS. 1*a*) and *b*) are schematic sectional views vertical to the bending axis of a first exemplary embodiment of a device according to the invention at two different times during implementation of the method according to the invention, and FIGS. 2*a*) to *f*) are schematic sectional views of a simulation of a second exemplary embodiment of the production method according to the invention at six different times.

DESCRIPTION

Figure 1:
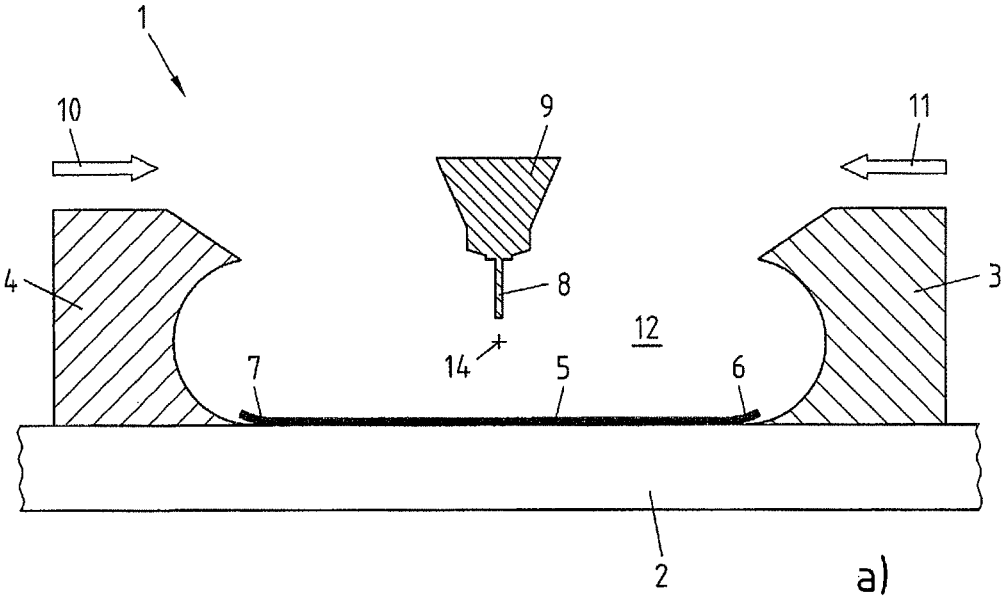
Figure 1:
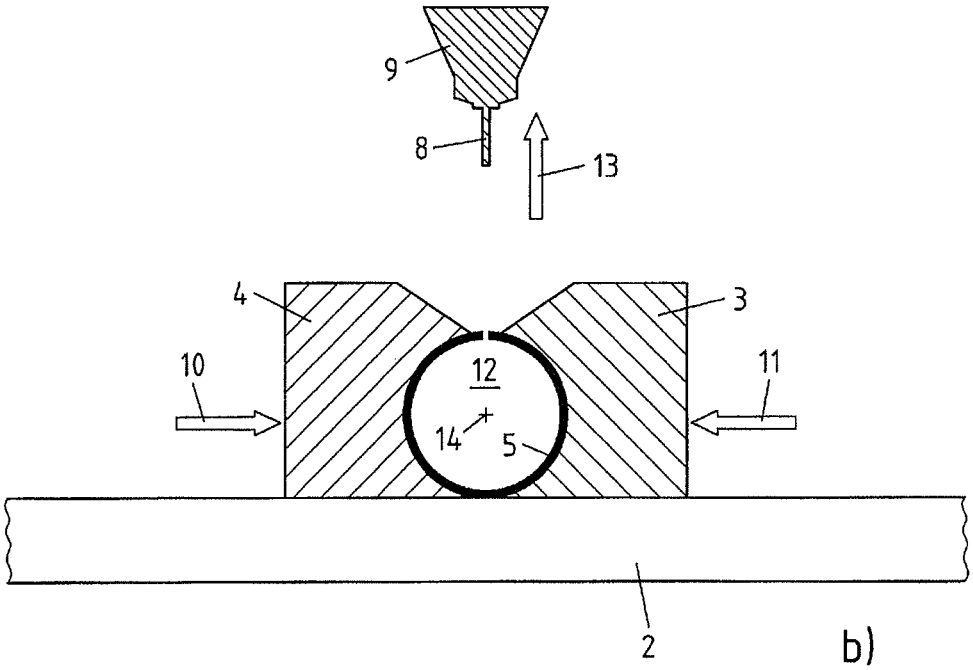

FIG. 1*a*) is a schematic sectional view of a first exemplary embodiment of a device according to the invention for the production of a hollow section 1, which device comprises a base plate 2 and two coreless die halves 3, 4 which are positioned displaceably with respect to one another and have the desired section shape of the hollow section to be produced. The blank 5 has edges 6, 7 which have been pre-bent in the deformation direction and extend parallel to the bending axis 14. Furthermore, FIG. 1*a*) also shows a tongue 8 which projects into the form cavity 12 and is positioned between the two die halves 3, 4.

In the present exemplary embodiment, the tongue 8 extends parallel to the bending axis 14 over the entire length of the die. However, it is also possible for a tongue 8 to be used which is repeatedly interrupted or which only projects at a few points into the form cavity 12.

When the method according to the invention is carried out, the die halves 3, 4 are moved towards one another according to the movement arrows 10, 11, so that the blank 5 positioned inside the form cavity 12 is formed corresponding to the die halves.

FIG. 1*b*) shows the exemplary embodiment of the device according to the invention at the end of the forming procedure. The blank has now been formed around the bending axis 14 into a hollow section 5 which is still open, for example in the form of a pipe. The tongue 8 required for the forming procedure is removed from the hollow section 5 according to the direction of movement 13 by the tongue holding means 9 moving vertically to the longitudinal axis of the hollow section 5, so that the hollow section or pipe 5 can now be straight bead welded. The exemplary embodiment shows a particularly simple hollow section in the form of a pipe. However, the device according to the invention or the method according to the invention also allows the production of many section shapes which can be unrolled in a plane. Thus, for example it is also possible to produce an oval-conical section with straight portions. In principle, after the tongue has been withdrawn, a further re-forming of the edges and/or a subsequent straight bead welding procedure, for example using a laser, can then be carried out. This straight bead welding procedure is preferably also integrated and carried out in the device according to the invention.

Figure 2A:
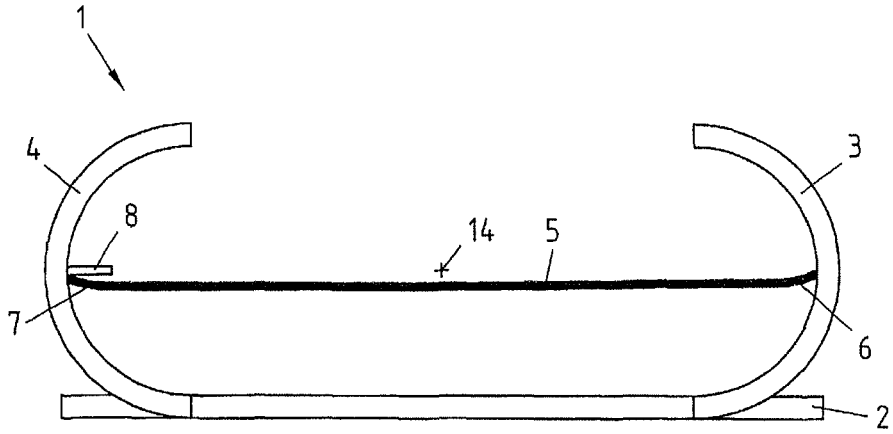

FIGS. 2*a*) to 2*f*) show in individual steps a simulation of a second exemplary embodiment of the method according to the invention for the production of a hollow section, here again on the basis of the production of a hollow section 5 in the form of a pipe in a sectional view at different times. First of all, the blank 5 which preferably has edges 6, 7 which have been pre-bent in the deformation direction is introduced into a device 1 according to the invention for the production of hollow sections according to the second exemplary embodiment. The device 1 comprises a die half 4 which has a tongue 8 extending in the longitudinal direction of the entire die half 4 or parallel to the bending axis 14.

Figure 2B:
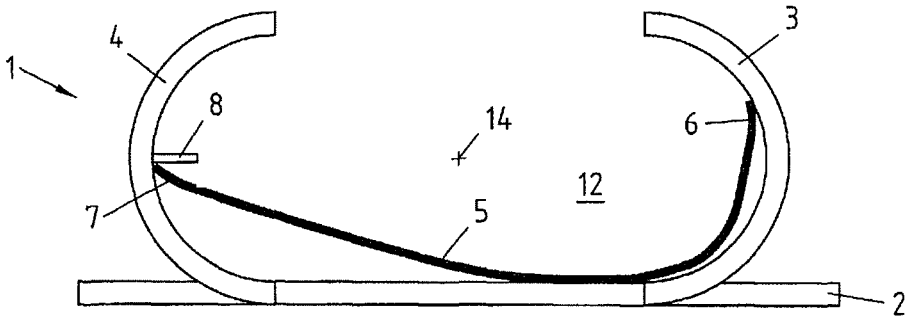
Figure 2C:
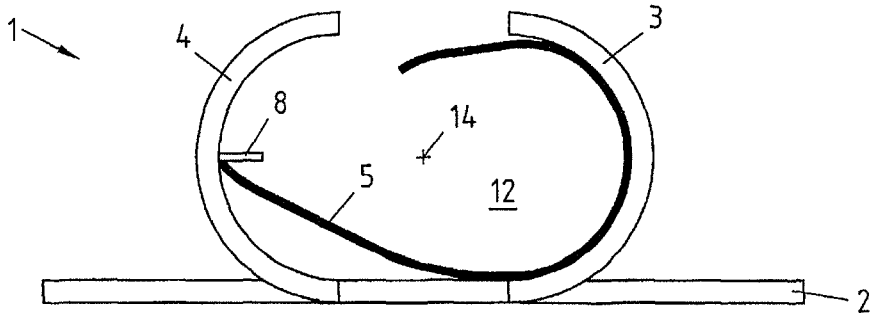
Figure 2D:
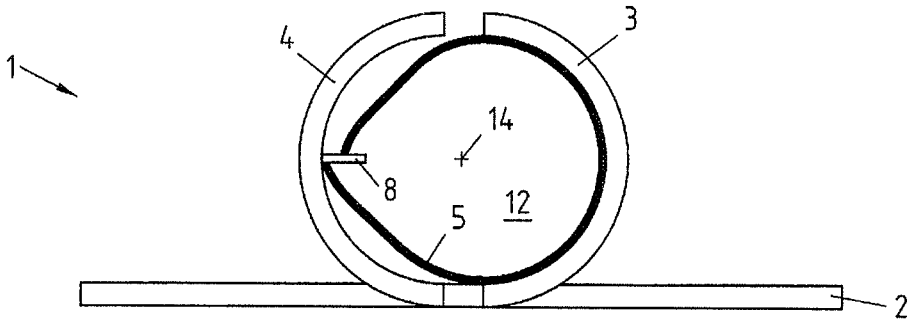
Figure 2E:
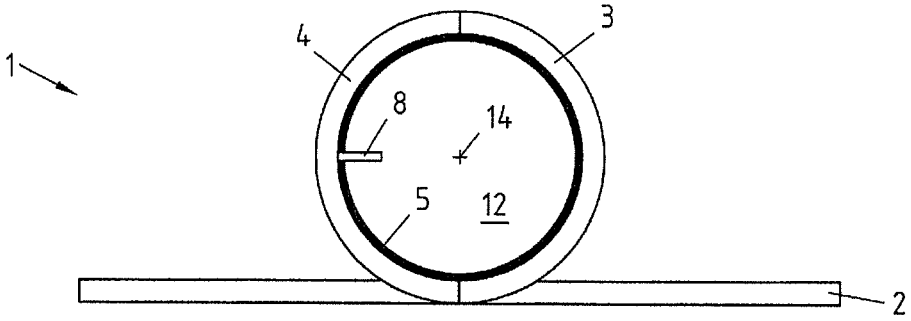

If the die halves 3, 4 are now moved towards one another, the pre-bent edge 7 of the blank impacts against the tongue 8 and this edge 7 of the blank is prevented from sliding ahead. On the other side, the opposite edge 6 of the blank can be freely formed until, as shown in FIG. 2*b*), it also impacts against the tongue 8 projecting into the form cavity 12. During the further movement path of the die halves 3, 4, pressure builds up in the peripheral direction in the inserted blank and forces the blank onto an increasingly large periphery. Finally, as shown in FIG. 2*e*), the blank impacts against the halves 3, 4 of the die so that a further closing movement increases the pressure present in the peripheral direction in the blank such that the formed hollow section is fully calibrated.

Surprisingly, between the forming steps, shown in FIGS. 2*b*) and 2*e*), the blank 5 does not require an additional guidance means, for example by an inner die core or die gaps or by being fixedly clamped, to ensure a procedurally reliable forming to produce the desired hollow section 5. This is all the more surprising, since up until now, experts in the field had assumed that in order to form a hollow section without flaws in a die, at least a die core was necessary or the hollow section had to be firmly clamped at least along an axis parallel to the bending axis.

Figure 2F:
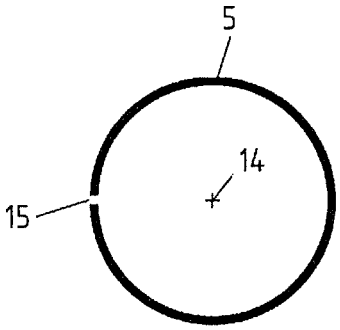

FIG. 2*f*) shows the cross-sectional shape of a slotted hollow section 5 produced according to the second exemplary embodiment which has just been described, after being removed from the device 1 according to the invention. The slot 15 of the hollow section is clearly visible. Due to the fact that full calibration can already be carried out inside the device 1, the hollow section which is produced is particularly dimensionally accurate and can be straight bead welded in a particularly effective manner. The method and device according to the invention are thus ideally suitable for the production of "tailored tubes".

The invention claimed is:

1. Method for production of a hollow section from a substantially flat blank, wherein the blank is introduced between two coreless halves of a die which have a desired section shape and can be displaced relative to one another and which have a base plate between them and the blank is formed into a slotted hollow section by a closing movement of the coreless halves of the die, edges of the blank are prevented from sliding ahead during the closing movement of the die to produce the slotted hollow section.

2. Method for the production of a hollow section according to claim 1, wherein to prevent the edges of the blank from sliding ahead, at least one tongue is used which projects into a coreless form cavity.

3. Method for the production of a hollow section according to claim 1, wherein a tongue is positioned between the coreless halves of the die or in one half of the die.

4. Method for the production of a hollow section according to claim 1, wherein the hollow section is fully calibrated during the closing procedure of the coreless halves of the die.

5. Method for the production of a hollow section according to claim 1, wherein the hollow section is fully calibrated without a tongue.

6. Method for the production of a hollow section according to claim 1, wherein the edges of the blank are pre-bent in the deformation direction.

7. Method for the production of a hollow section according to claim 1, wherein the blank is secured against displacement in the direction of the bending axis.

8. Method for the production of a hollow section according to claim 2, wherein after the tongue has been removed, the hollow section is straight bead welded.

9. Method for the production of a hollow section according to claim 1, wherein tailored tubes are produced.

10. Method for the production of a hollow section according to claim 1, wherein a deep drawing press, a press brake or a rolling device is used to perform the method.

* * * * *